US006405519B1

(12) United States Patent
Shaikh et al.

(10) Patent No.: US 6,405,519 B1
(45) Date of Patent: Jun. 18, 2002

(54) COMPOSITE, BREAK-RESISTANT SEWING THREAD AND METHOD

(75) Inventors: Humayan N. Shaikh, District Kasur (PK); Robert W. Downs, Lincolnton; Charles Rex Childers, Cornelius, both of NC (US)

(73) Assignee: Burke Mills, Inc., Valdese, NC (US)

( * ) Notice: Subject to any disclaimer, the term of this patent is extended or adjusted under 35 U.S.C. 154(b) by 0 days.

(21) Appl. No.: 09/511,565

(22) Filed: Feb. 23, 2000

(51) Int. Cl.[7] ..... D02G 3/36

(52) U.S. Cl. ..... 57/210; 57/3; 57/6; 57/12; 57/211; 57/224; 57/225; 57/226; 57/228; 57/285; 57/328

(58) Field of Search ..... 57/3, 6, 12, 210, 57/211, 224, 225, 226, 228, 285, 328

(56) References Cited

U.S. PATENT DOCUMENTS 4,069,656 A 1/1978 Arai et al.
4,495,760 A * 1/1985 Vanhelle ..... 57/211
5,383,331 A * 1/1995 Proctor ..... 57/225
5,568,719 A * 10/1996 Proctor ..... 57/225
5,619,848 A 4/1997 Costales et al.
6,146,759 A * 11/2000 Land ..... 428/370

OTHER PUBLICATIONS

Murata Machinery, Ltd.; "High Speed Air–Jet Spinning Frames"; Section 1, pp. J–1 through J–24; 1996.
Murata Machinery, Ltd.; "High Speed Air–Jet Spinning Frames"; Section 13, pp. D–27 through D–34; 1996.
Murata Machinery, Ltd.; "New Spun Yarn"; Entire Brochure; Published prior to Feb. 23, 2000.
Murata Machinery, Ltd.; "Murata Jet Spinner"; General Catalog for MJS; Entire Catalog; Published prior to Feb. 23, 2000.

* cited by examiner

*Primary Examiner*—John J. Calvert
*Assistant Examiner*—Shaun R Hurley
(74) *Attorney, Agent, or Firm*—Adams, Schwartz & Evans, P.A.

(57) ABSTRACT

A composite, break-resistant sewing thread having a core of continuous multi-filament, non-stretch high-tenacity synthetic yarn and a cover of drafted staple fibers air-jet twisted around and covering the core for protecting the core from heat and friction during a sewing operation. The yarn is plied.

19 Claims, 6 Drawing Sheets

Fig. 5A
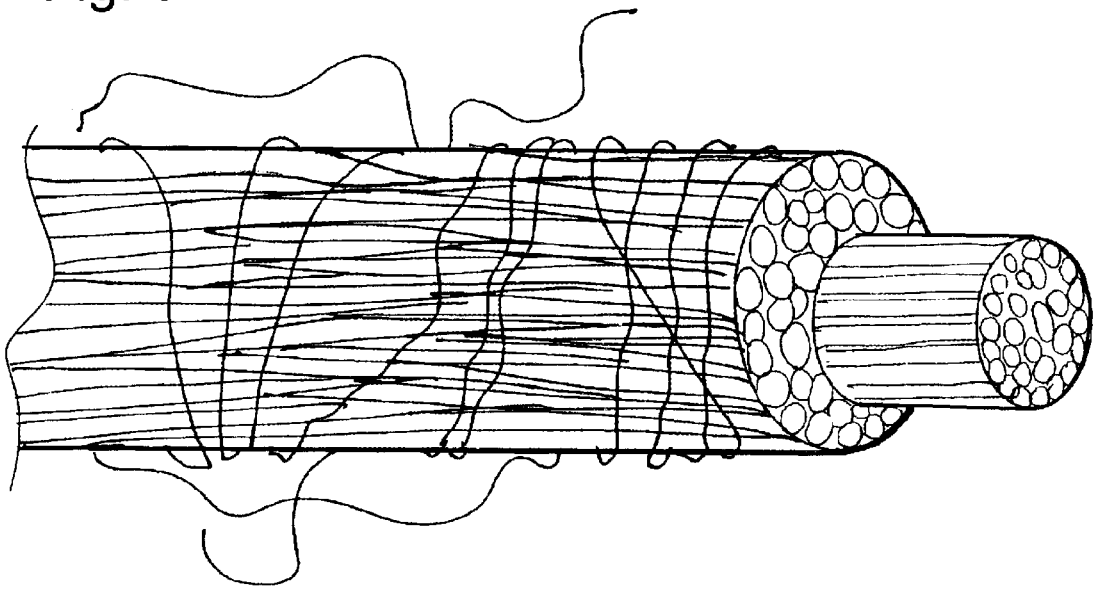
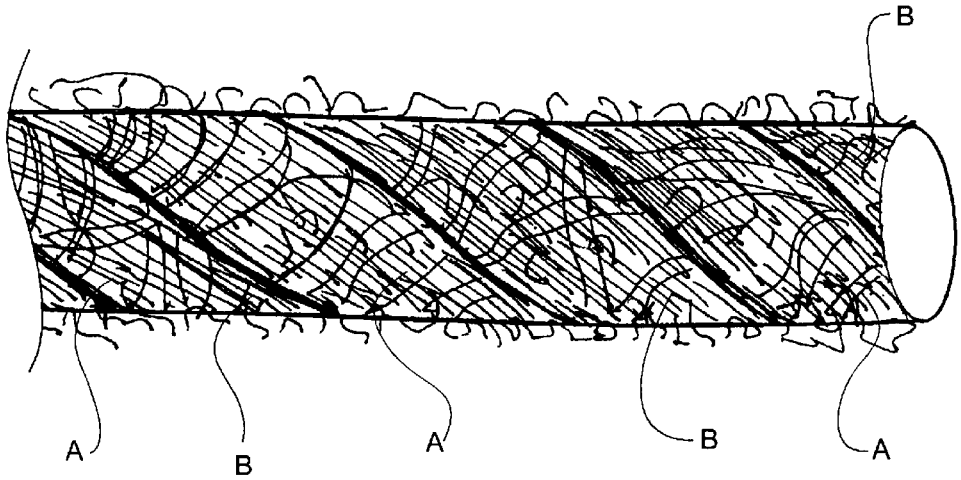
Fig. 5B

COMPOSITE, BREAK-RESISTANT SEWING THREAD AND METHOD

TECHNICAL FIELD AND BACKGROUND OF THE INVENTION

This invention relates to a composite, break-resistant sewing thread and a method of manufacturing the sewing thread. The product and method departs from prior art yarns and methods in that the product is intended to produce a relatively hard, high-twist yarn rather than a soft, low-twist yarn. Prior art core-spun yarns are produced with staple fibers on the surface of the composite yarn in order to soften the feel of the yarn and provide a yarn which resembles ring-spun, 100% staple-fiber yarns. Thus, feel and appearance are the principal factors determining the design and production of the yarn. Such yarns generally have a relatively high degree of elongation.

In contrast, sewing thread must be strong and relatively inelastic. This has been accomplished in the prior art by ring-spinning sewing thread with 100% cotton, blends of cotton and staple synthetic fibers such as polyester, or 100% staple synthetic fibers, with the insertion of high twist. This imparts to the sewing thread a hard finish and reduces elongation, making the yarn susceptible to breakage. Achieving a proper balance between the twist necessary to impart additional strength and too much twist which can increase breakage under certain processing conditions has been a continuing problem in the manufacture of conventional sewing thread.

One solution to this problem has been to utilize high tenacity filament sewing thread thereby avoiding the use of staple fibers altogether. While such filament sewing threads can be made very break-resistant, they also have disadvantages, including a slick, cheap appearance, short, stiff cut ends which can irritate the skin of the wearer of garments made with the thread, and sensitivity to heat, friction and abrasion which can soften and elongate the yarn, and, in extreme cases, cause the yarn to separate.

Manufacturers who purchase and use sewing thread monitor thread break frequency and return thread or demand refund or credit for yarn which exceeds maximum thread break standards. This, of course, raises the cost to the thread manufacturer of producing the thread and can result in loss of business or good will. The present invention provides a sewing thread which can be efficiently manufactured with consistent quality and which provides superior performance.

SUMMARY OF THE INVENTION

Therefore, it is an object of the invention to provide a composite, break-resistant sewing thread which has enhanced resistance to breakage.

It is another object of the invention to provide a composite, break-resistant sewing thread which has a high-strength core yarn.

It is another object of the invention to provide a composite, break-resistant sewing thread which has a high-strength core yarn and a staple fiber cover yarn which protects the core yarn from heat and friction.

It is another object of the invention to provide a composite, break-resistant sewing thread which can be made in a continuous process on an air-jet spinning machine.

It is another object of the invention to provide a method for manufacturing a composite yarn, including a sewing thread, which has improved processing and use characteristics.

These and other objects of the present invention are achieved in the preferred embodiments disclosed below by providing a composite, break-resistant sewing thread, comprising a core comprising a continuous filament, non-stretch high-tenacity synthetic yarn and a cover comprising drafted staple fibers air-jet twisted around and covering the core for protecting the core from heat and friction during a sewing operation.

According to one preferred embodiment of the invention, the core comprises at least 55 percent of the total weight of the composite thread.

According to another preferred embodiment of the invention, the core is a fully-oriented polyester yarn.

According to yet another preferred embodiment of the invention, the yarn includes a second core yam plied with the core yarn.

According to yet another preferred embodiment of the invention, the core is a fully-oriented polyester yarn having a denier between 60 and 250.

According to yet another preferred embodiment of the invention, the cover is polyester.

According to yet another preferred embodiment of the invention, the cover is cotton.

According to yet another preferred embodiment of the invention, the core comprises at least 60 percent of the total weight of the composite thread.

According to yet another preferred embodiment of the invention, the core comprises at least 76 percent of the total weight of the composite thread.

An embodiment of the method of producing a composite, break-resistant non-stretch sewing thread according to the invention comprises the steps of feeding a sliver of staple fibers through a plurality of successive drafting zones, introducing a continuous filament, high-tenacity synthetic yarn into the sliver downstream of the drafting zones and upstream of an air-jet spinning zone, air-jet spinning the sliver in the air-jet spinning zone around the continuous filament yarn to form a core comprising the continuous filament yarn covered with staple fibers comprising a cover for protecting the core from heat and friction during a sewing operation.

According to one preferred embodiment of the invention, the method includes the steps of doubling two yarns produced according to the method and twisting the doubled yarn to form a two-ply twisted yarn.

BRIEF DESCRIPTION OF THE DRAWINGS

Some of the objects of the invention have been set forth above. Other objects and advantages of the invention will appear as the invention proceeds when taken in conjunction with the following drawings, in which:

FIGS. 5A–D are enlarged schematic views of yarns produced according to the present invention.

DESCRIPTION OF THE PREFERRED EMBODIMENT AND BEST MODE

Figure 1:
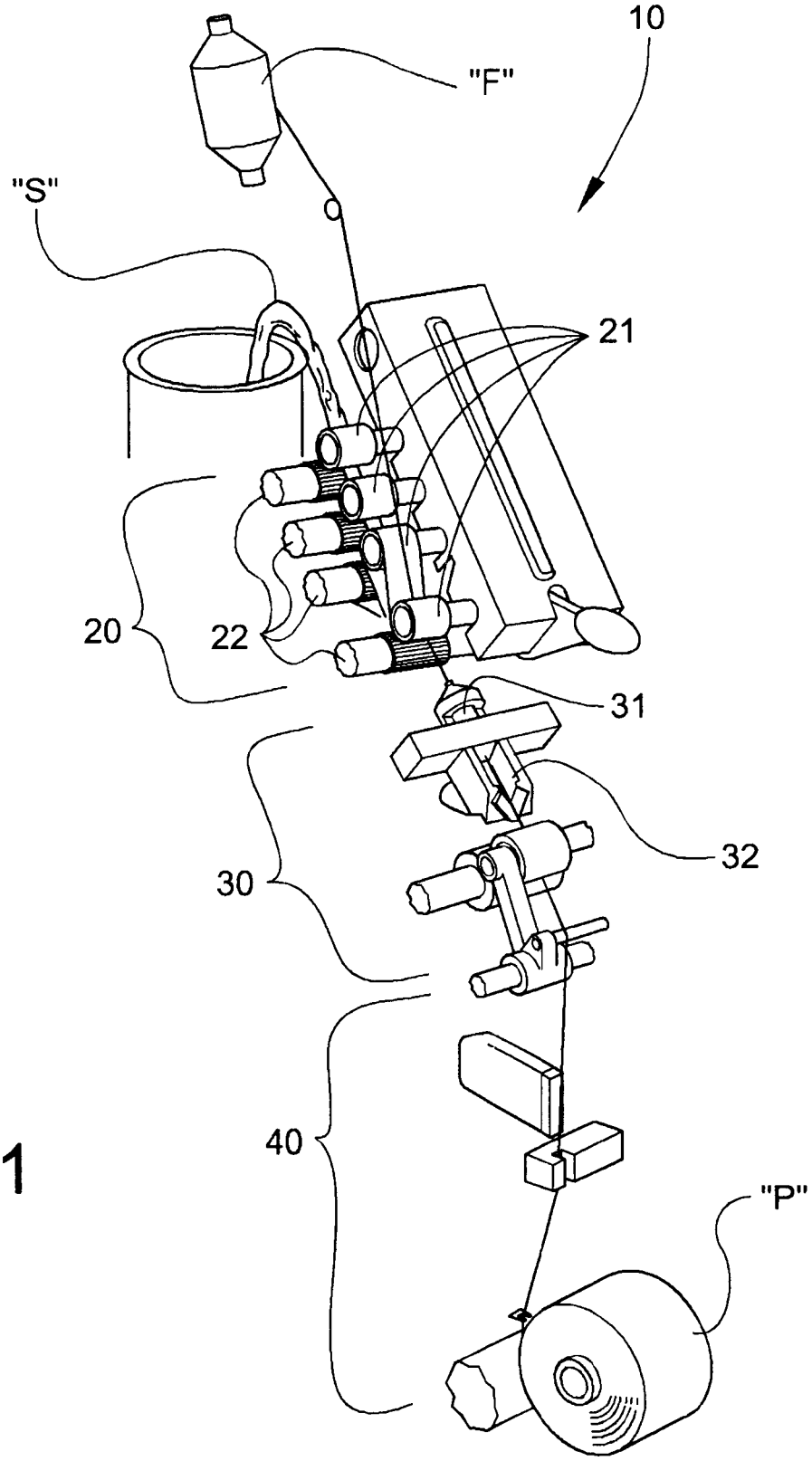
FIG. 1 is a schematic perspective view of a Murata Jet Spinning machine configured for making a composite yarn according to an embodiment of the invention.

Referring now specifically to the drawings, a schematic diagram of a Murata MJS Jet Spinner machine which can be configured to produce a yarn according to the present invention is illustrated in FIG. 1 and shown generally at reference numeral 10. Machine 10 includes a drafting zone 20, a spinning zone 30 and a winding zone 40. In conventional jet spinning, a drawn sliver "F" is supplied directly to sets of upper and lower drafting rolls 21, 22, where the sliver is drafted by moving the generally longitudinally-extending fibers past each other in a controlled manner and at controlled rate. The drafted fibers pass through two compressed air nozzles 31, 32 in the spinning zone 30. Compressed air discharged by nozzle 31 whirls about the axis of the nozzle in a direction opposite that discharged by the nozzle 32, thus producing a yam. The nozzle 32 gathers a group of fibers fed from the drafting rolls 21, 22 by false twisting. Between the front roller in the drafting zone 20 and nozzle 32 the compressed air discharged by nozzle 31 rotates about the axis of nozzle 31 in the direction opposite to that in which the nozzle 32 gathered and twisted the fibers, creating a counter-whirling force opposite to that with which the core fibers were twisted by the nozzle 32. Thus, some fibers are separated during this false twisting.

The counter-whirling force generated by the nozzle 31 coils the separated fibers around the previously-twisted fibers in the direction opposite to that with which the previously-twisted fibers were twisted by the nozzle 32. The fibers that passed through the nozzle 32 are more tightly wrapped around the previously-twisted fibers by the untwisting force resulting from the false twisting.

The twisted yarn then passes into the winding zone where the yarn is wound onto a take-up package "P" in the form of a composite yarn "C".

Figure 2:
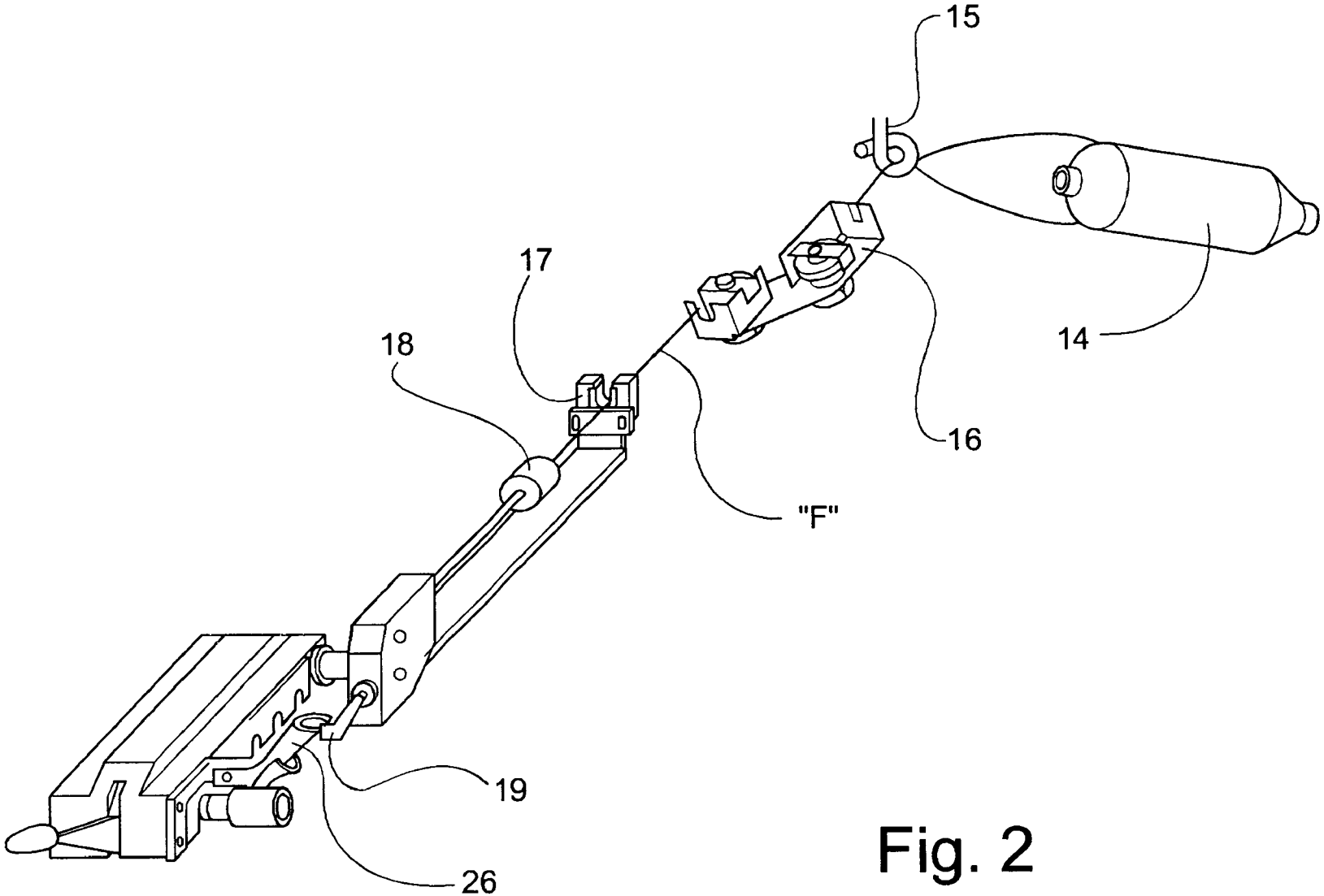
FIG. 2 is a schematic perspective view of the core yarn feeding unit of the machine illustrated in FIG. 1.
Figure 3:
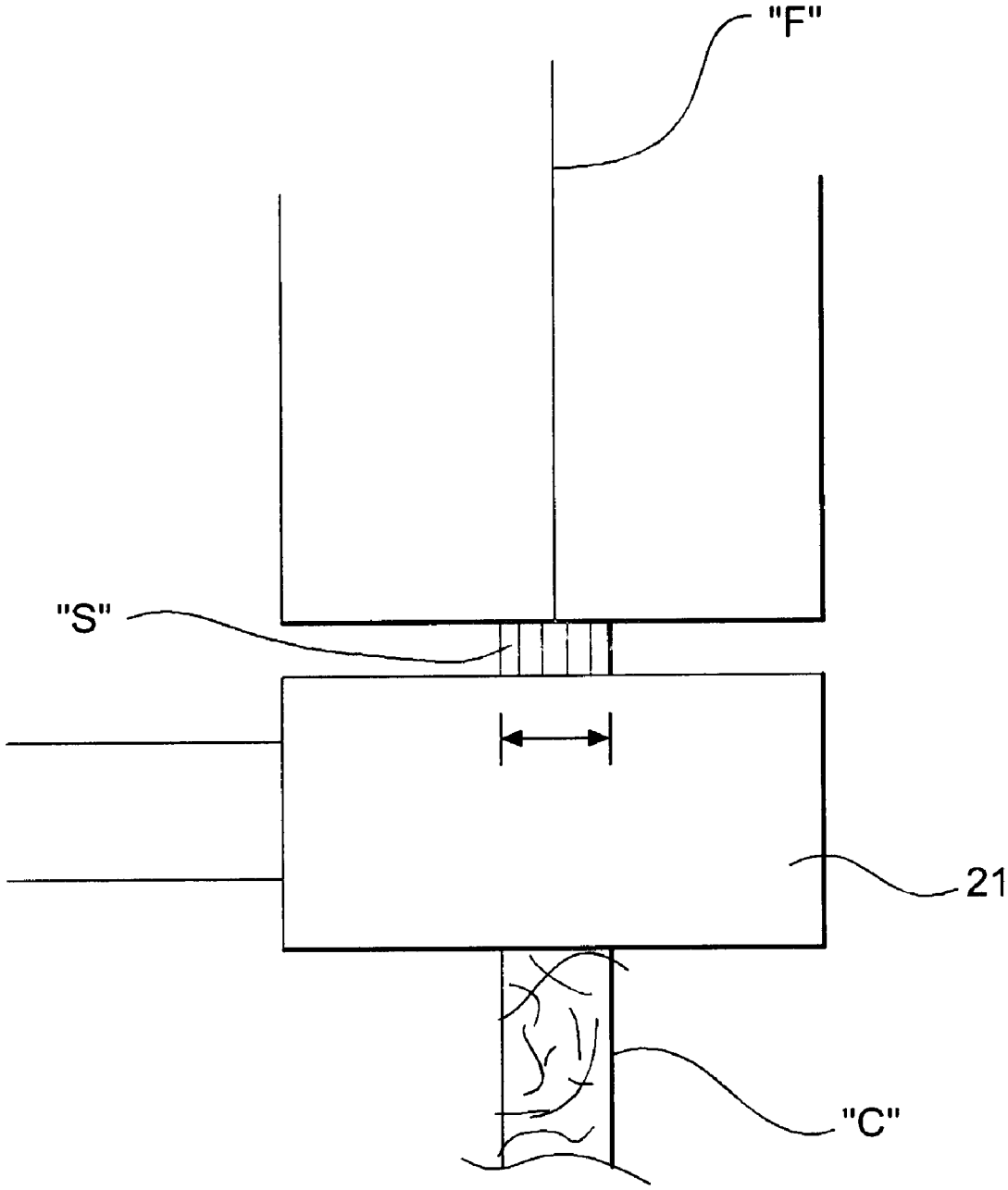
FIG. 3 is a fragmentary schematic view of the introduction of the core yarn into the cover yarn sliver.

In the practice of the present invention, the filament yarn "F" is fed into the sliver downstream of the last drafting zone and is integrated into the sliver bundle before twisting begins in the spinning zone 30. As is shown in FIG. 2, the filament yarn "F" is fed from a supply package 14 through a pigtail guide 15, a tension device 16, a feeler 17 and an air sucker 18. The filament "F" is then passed through a core yarn delivery tube 19 and then into a sliver delivery tube 26, where the integration of the filament yarn "F" and the sliver "S" occurs. As is shown in FIG. 3, the filament yarn yarn "F" should be introduced into the center of the sliver "S". Since drafting has already taken place, the filament yarn "F" becomes the core of the composite yarn "C".

Figure 4:
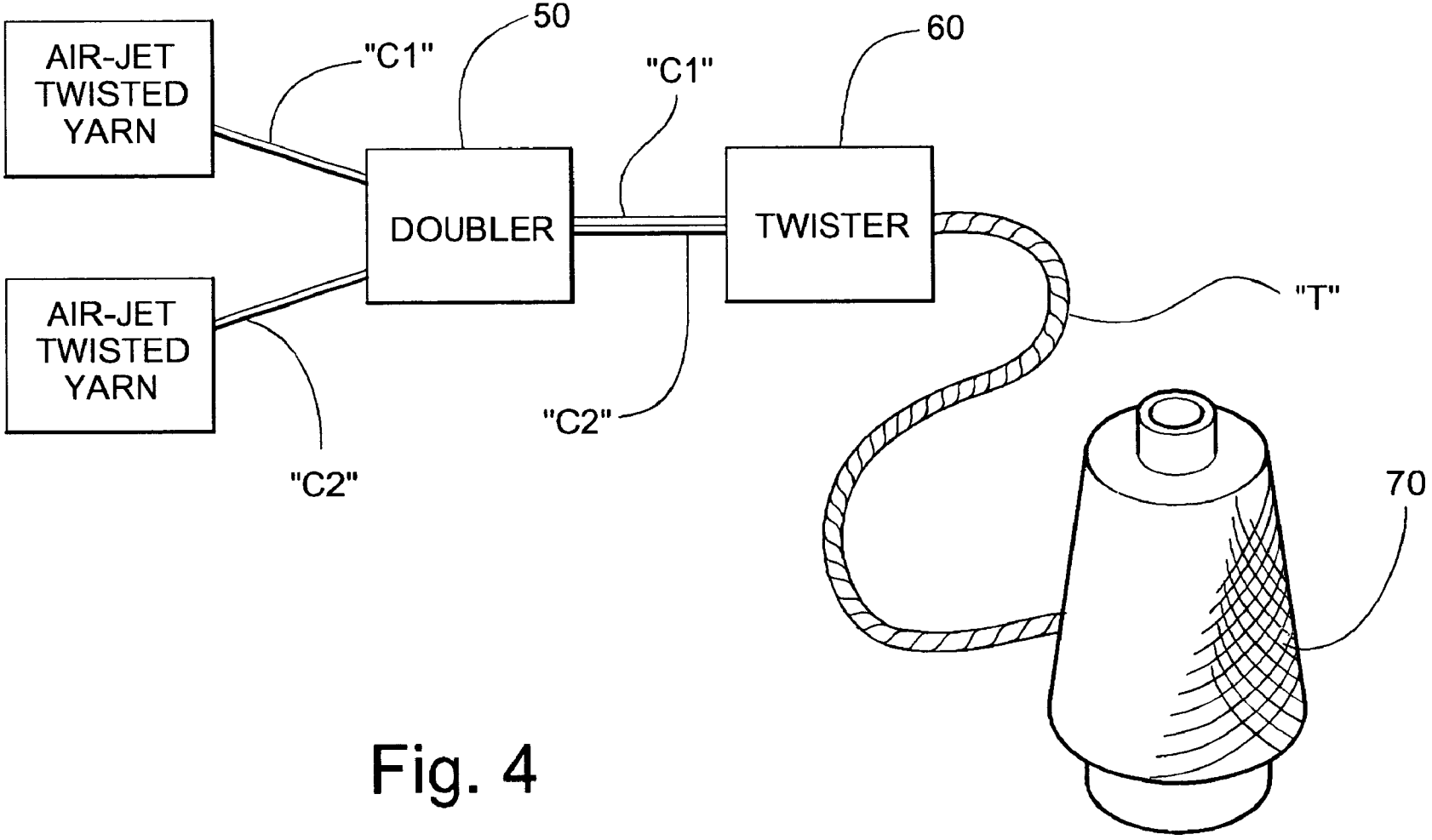
FIG. 4 is a schematic diagram showing formation of a two-ply yarn in accordance with an embodiment of the invention.
Figure 5C:
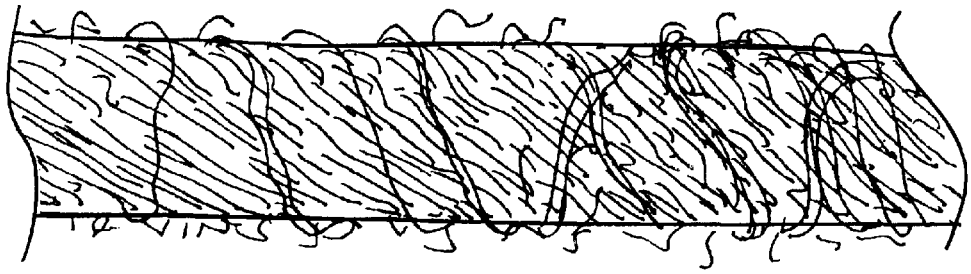
Figure 5D:
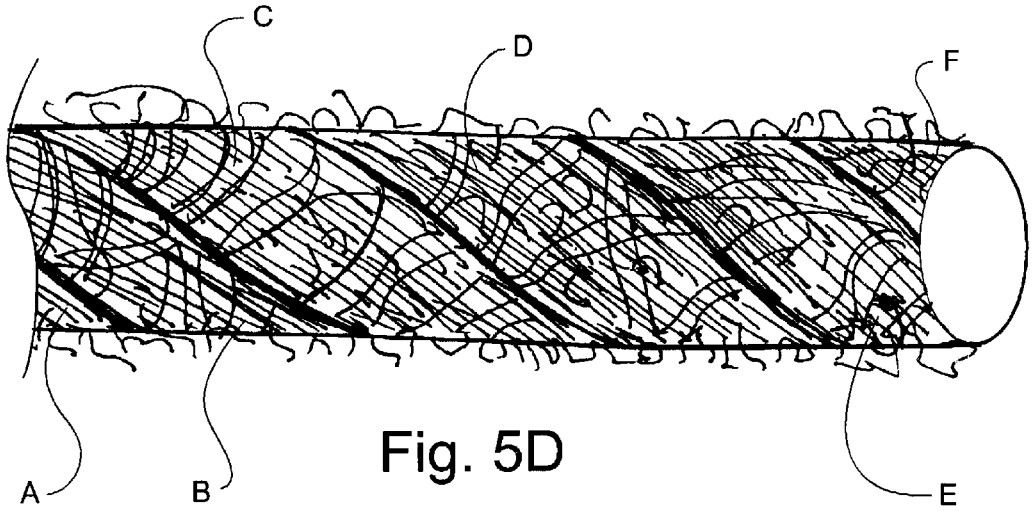

As is shown in FIG. 4, two such composite yarns "C1" and "C2" may be doubled on a conventional doubler 50 to form a doubled yarn, which is then conveyed to a twister 60 where conventional twist is inserted to form a twisted two ply yarn "T" which is then wound onto a take-up package 70.

Finally, the yarn "C" or "T" is heat stabilized by a wet process at a temperature of 250–270 Degrees F.

Examples of yarns made in accordance with the invention are described below and illustrated in FIGS. 5A–5D.

TABLE 1

PHYSICAL PROPERTIES

| YARN SIZE | SINGLES SPIN SIZE | PLY SPIN SIZE | PLY TWIST Z | CORE DENIER | COVER FIBER | CORE/COVER RATIO |
|---|---|---|---|---|---|---|
| 45/2 | 44 | 42 | 20 | 67 H.C. | High Tenacity Staple | 60/40 |
| 35/2 | 35 | 34.3 | 18 | 90 H.C. | High Tenacity Staple | 61/39 |
| 29/2 | 29 | 28.4 | 18 | 125 H.C. | High Tenacity Staple | 60/40 |
| 18/2 | 18.5 | 17.5 | 12 | 220 H.C. | High Tenacity Staple | 75/25 |
| 16./2 | 18.5 | 15.5 | 11 | 230 | HIgh Tenacity Staple | 70/30 |
| 18/3 | 18.5 | 18 | 10 | 220 | High Tenacity Staple | 68/42 |

| YARN SIZE | % ELONGATION | COEFICIENT OF BREAK STRENGTH FRICTION | MINIMUM/GRAMS | ACTUAL COUNT | % FINISH | TWIST |
|---|---|---|---|---|---|---|
| 45/2 | 16–18 | .15–.20 | 975 | 42/2 | 4% –8% | 19–21 |

TABLE 2

SET-UP SHEET
MURATA AIR SET SPINNING
CORESPUN THREAD

| | |
|---|---|
| DATE | 1-10-2000 |
| YARN NUMBER | 18/1 for 18/2 |
| FIBER TYPE | High Tenacity |
| FIBER LENGTH | 1 ½" |
| FIBER DENIER | 1.2 |
| GRAIN SLIVER | 31.0 |
| FILAMENT TYPE | High Tenacity |
| FILAMENT DENIER | 220 |
| PERCENT SHEATH | 25.5 |
| PERCENT CORE | 74.5 |
| MACHINE SPEED | 220 m/min |
| TOTAL DRAFT | 145 |
| MAIN DRAFT | 35 |
| FEED RATIO | 98 |
| DELIVERY RATIO | 99 |
| CONDENSER | 8 |
| DISTANCE NI TO FRONT ROLL | 39 |
| AIR PRESSURE N1 | 2.0 |
| AIR PRESSURE N2 | 5.0 |
| TYPE NOZZLE N1 | S TWIST - H26 |
| TYPE NOZZLE N2 | S TWIST - H26 |
| TWIST CONTROLLER | 6* |
| TRUMPET SIZE | 9 |
| STDE PLATE | 44/42 |
| APRON PRESSURE | 3.0 kg |
| N2 GUIDE | 3.2 purple |
| TENSION BAR | 3.38 |
| CREEL TENSION | 15 gms |
| CRADLE SETTING | 2.5–3.0 |
| TRAVERSE SPEED | 11.0° |
| KNOTTER TENSION | 1.5 kg |
| BOTTOM ROLL SETTINGS | 44-41.5-42-42 |
| SELETEX SETTING | |
| METER SETTING | |
| SENSITIVITY | |
| PACKAGE COLOR | |

TABLE 3

| SET-UP SHEET MURATA AIR JET SPINNING CORESPUN THREAD | |
|---|---|
| DATE | 1-10-2000 |
| YARN NUMBER | 18/1 for 18/3 |
| FIBER TYPE | High Tenacity Polyester |
| FIBER LENGTH | 1 ½" |
| FIBER DEMER | 1.2 |
| GRAIN SLIVER | 31.0 |
| FILAMENT TYPE | High Tenacity |
| FILAMENT DEMER | 170 |
| PERCENT SHEATH | 42.4 |
| PERCENT CORE | 57.6 |
| MACHINE SPEED | 205 m/min |
| TOTAL DRAFT | 82.3 |
| MAIN DRAFT | 35.0 |
| FEED RATIO | 98 |
| DELIVERY RATIO | 99 |
| CONDENSER | #8 |
| DISTANCE N1 TO FRONT ROLL | 39 mm |
| AIR PRESSURE N1 | 2.5 |
| AIR PRESSURE N2 | 5.0 |
| TYPE NOZZLE N1 | S TWIST - H26 |
| TYPE NOZZLE N2 | S TWIST - H26 |
| TWIST CONTROLLER | 6* |
| TRUMPET SIZE | 9 mm |
| SIDE PLATE | 41/42 |
| APRON PRESSURE | 3.0 kg |
| N2 GUIDE | 3.2 purple |
| TENSION BAR | 2.88 |
| CREEL TENSION | 15 gms |
| CRADLE SETTING | 2.5–3.0 |
| TRAVERSE SPEED | 11.0° |
| KNOTTER TENSION | 1.5 kg |
| BOTTOM ROLL SETTINGS | 44-41.5-42-42 |
| SELETEX SETTING | |
| METER SETTING | |
| SENSITIVITY | |
| PACKAGE COLOR | |

TABLE 4

| SET-UP SHEET MLRATA AIR JET SPINNING CORESPUN THREAD | |
|---|---|
| DATE | 1-10-2000 |
| YARN NUMBER | 45/1 for 45/2 |
| FIBER TYPE | High Tenacity Polyester |
| FIBER LENGTH | 1.5" |
| FIBER DENIER | 1.2 |
| GRAIN SLIVER | 31.0 |
| FILAMENT TYPE | High Tenacity |
| FILAMENT DENIER | 67 |
| PERCENT SHEATH | 395 |
| PERCENT CORE | 60.5 |
| MACHINE SPEED | 205 m/min |
| TOTAL DRAFT | 206.5 |
| MATN DRAFT | 41 |
| FEED RATIO | 98 |
| DELWERY RATIO | 99 |
| CONDENSER | 7 |
| DISTANCE N1 TO FRONT ROLL | 39 |
| AIR PRESSURE N1 | 2.5 |
| AIR PRESSURE N2 | 5.0 |
| TYPE NOZZLE N1 | S TWIST - H3 |
| TYPE NOZZLE N2 | S TWIST - H3 |
| TWIST CONTROLLER | 6* |
| TRUMPET SIZE | 9 mm |
| SIDE PLATE | 41/42 |

TABLE 4-continued

| SET-UP SHEET MLRATA AIR JET SPINNING CORESPUN THREAD | |
|---|---|
| DATE | 1-10-2000 |
| YARN NUMBER | 45/1 for 45/2 |
| APRON PRESSURE | 3.0 kg |
| N2 GUIDE | 2.2 triangle |
| TENSION BAR | 2.88 |
| CREEL TENSION | 15 gms |
| CRADLE SETTING | 2.5–3.0 |
| TRAVERSE SPEED | 11.0° |
| KNOTTER TENSION | 1.5 kg |
| BOTTOM ROLL SETTINGS | 44-41.5-42-42 |
| SELETEX SETTING | |
| METER SETTING | |
| SENSITIVITY | |
| PACKAGE COLOR | |

TABLE 5

| SET-UP SHEET MURATA AIR JET SPINNING CORESPUN THREAD | |
|---|---|
| DATE | 1-10-2000 |
| YARN NUMBER | 16/1 for 16/2 |
| FIBER TYPE | High Tenacity |
| FIBER LENGTH | 1.5" |
| FIBER DENIER | 1.2 |
| GRAIN SLIVER | 31.0 |
| FILAMENT TYPE | High Tenacity |
| FILAMENT DEMER | 67 |
| PERCENT SHEATH | 30.76 |
| PERCENT CORE | 69.24 |
| MACHINE SPEED | 205 m/min |
| TOTAL DRAFT | 106.6 |
| MAIN DRAFT | 35.0 |
| FEED RATIO | 98 |
| DELIVERY RATIO | 99 |
| CONDENSER | #10 |
| DISTANCE N1 TO FRONT ROLL | 39 |
| AIR PRESSURE N1 | 2.0 |
| AIR PRESSURE N2 | 5.0 |
| TYPE NOZZLE N1 | S TWIST - H26 |
| TYPE NOZZLE N2 | S TWIST - H26 |
| TWIST CONTROLLER | |
| TRUMPET SIZE | 9 mm |
| SIDE PLATE | 41/42 |
| APRON PRESSURE | 3.0 kg |
| N2 GUIDE | 3.2 purple |
| ThNSION BAR | 2.88 |
| CREEL TENSION | 15 gms |
| CRADLE SETTING | 2.5–3.0 |
| TRAVERSE SPEED | 12.0° |
| KNOTTER TENSION | 1.5 kg |
| BOTTOM ROLL SETTINGS | 44-41.5-42-42 |
| SELETEX SETTING | |
| METhR SETTING | |
| SENSITIVITY | |
| PACKAGE COLOR | |

Sewing threads made in accordance with the invention utilize as the core a fully-oriented, continuous filament, high-tenacity, low twist yarn of between 67 and 250 denier. Processing tension is quite low for the core, in the range of approximately 1/10 grams per denier solely for the purpose of the controlling the wrap for the cover yarn. The ratio of core yarn to cover yarn is preferably 65% core to 35% cover. The process is designed to increase the twist and thus produce a strong yarn capable of withstanding the stresses to which sewing thread is subjected, and to increase the product thickness by 30 to 40 percent when the cover is applied.

Sewing thread as described above and made in accordance with the method of the application have proven to provide superior results in commercial production, as set out in the following Example 1.

EXAMPLE 1

Sewing tests were carried out over three months in a modern towel-fabricating plant using both white and dyed 45/2 yarn "T" as in the above Table 1. Automated sewing equipment was used to reduce the effect of differences in operator skill. Comparison was with a 45/2 ringspun yarn. Standard thread break frequency was one occurrence per 680 towels (1360 seams), meaning that any higher frequency of breaks is considered unacceptable. Use of yarn "T" resulted in an average of one break every ,2,513 towels sewn (5,016 seams) with individual results as high as one occurrence per 4,045 towels (8,090 seams). Subsequently, tests were carried out at six other towel facilities under differing conditions with similar results. Similar results have also been obtained in a sheet fabricating plant.

A composite sewing thread and method is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A composite, break-resistant sewing thread, comprising:

(a) a core comprising a continuous filament, non-stretch, fully oriented high-tenacity synthetic yarn; and (b) a cover comprising drafted staple fibers air-jet twisted around and covering the core for protecting the core from heat and friction during a sewing operation.

2. A composite, break-resistant sewing thread according to claim 1, wherein the core comprises at least 55 percent of the total weight of the composite thread.

3. A composite, break-resistant sewing thread according to claim 1, and including a second core yarn plied with the core yarn.

4. A composite, break-resistant sewing thread according to claim 1, wherein the core is a filly-oriented polyester yarn having a denier between 60 and 250.

5. A composite, break-resistant sewing thread according to claim 1, wherein the cover is cotton.

6. A composite, break-resistant sewing thread according to claim 1, wherein the cover is polyester.

7. A composite, break-resistant sewing thread according to claim 1, wherein the core comprises at least 60 percent of the total weight of the composite thread.

8. A composite, break-resistant sewing thread according to claim 1, wherein the composite yarn contains between 5 and 25 twists per inch.

9. A composite, break-resistant sewing thread according to claim 1, wherein the core comprises at least 70 percent of the total weight of the composite thread.

10. A method of producing a composite, break-resistant, non-stretch sewing thread, comprising the steps of:

(a) feeding a sliver of staple fibers through a plurality of successive drafting zones;

(b) introducing a continuous filament, high-tenacity synthetic yarn into the sliver downstream of the drafting zones and upstream of an air-jet spinning zone; and (c) air-jet spinning the sliver in the air-jet spinning zone around the continuous filament yarn to form a core comprising the continuous filament yarn covered with staple fibers comprising a cover for protecting the core from heat and friction during a sewing operation.

11. A method according to claim 10, wherein the core comprises at least 55 percent of the total weight of the composite thread.

12. A method according to claim 10, wherein the core is a fully-oriented polyester yarn.

13. A method according to claim 10, and including a second core yarn plied with the core yarn.

14. A method according to claim 10, wherein the core is a fully-oriented polyester yarn having a denier between 60 and 250.

15. A method according to claim 10, wherein the cover is cotton.

16. A method according to claim 10, wherein the core comprises at least 60 percent of the total weight of the composite thread.

17. A method according to claim 10, wherein the core comprises at least 76 percent of the total weight of the composite thread.

18. A method according to claim 10, 12, 13, 14, 15, 16, or 17 and including the additional steps of:

(d) doubling one or more yarns produced according to process steps (a), (b) and (c); and (e) twisting the doubled yarn to form a one or more-ply twisted yarn.

19. A composite, break-resistant sewing thread, comprising:

(a) a core comprising a continuous filament, non-stretch high-tenacity synthetic yarn; and (b) a cover comprising drafted staple fibers air-jet twisted around and covering the core for protecting the core from heat and friction during a sewing operation wherein the composite thread contains between 5 and 25 twists per inch.

* * * * *

UNITED STATES PATENT AND TRADEMARK OFFICE

CERTIFICATE OF CORRECTION

PATENT NO. : 6,405,519 B1
DATED : June 18, 2002
INVENTOR(S) : Shaikh et al.

It is certified that error appears in the above-identified patent and that said Letters Patent is hereby corrected as shown below:

Column 7,
Line 47, delete “filly-oriented” and enter -- fully-oriented --.

Signed and Sealed this

Twenty-fifth Day of October, 2005

JON W. DUDAS
*Director of the United States Patent and Trademark Office*